US008449090B2

(12) United States Patent
Midorikawa

(10) Patent No.: US 8,449,090 B2
(45) Date of Patent: May 28, 2013

(54) INK JET RECORDING APPARATUS

(75) Inventor: Masaru Midorikawa, Chiba (JP)

(73) Assignee: Seiko I Infotech Inc. (JP)

( * ) Notice: Subject to any disclaimer, the term of this patent is extended or adjusted under 35 U.S.C. 154(b) by 367 days.

(21) Appl. No.: 12/802,402

(22) Filed: Jun. 7, 2010

(65) Prior Publication Data

US 2010/0309264 A1 Dec. 9, 2010

(30) Foreign Application Priority Data

Jun. 8, 2009 (JP) ..... 2009-137668
Apr. 5, 2010 (JP) ..... 2010-087245

(51) Int. Cl.
*B41J 2/175* (2006.01)

(52) U.S. Cl.
USPC ..... 347/86; 347/85

(58) Field of Classification Search
USPC ..... 347/7, 85, 86, 87
See application file for complete search history.

(56) References Cited

U.S. PATENT DOCUMENTS 5,307,091 A * 4/1994 DeCoste, Jr. ..... 347/86
5,691,755 A * 11/1997 Pawlowski et al. ..... 347/86
6,220,702 B1 * 4/2001 Nakamura et al. ..... 347/86
6,536,885 B2 * 3/2003 Kuribayashi et al. ..... 347/85
6,830,322 B2 * 12/2004 Shihoh et al. ..... 347/86
7,677,712 B2 * 3/2010 Ishizawa et al. ..... 347/86
7,984,980 B2 * 7/2011 Kachi ..... 347/86
2002/0158954 A1 10/2002 Usui et al. ..... 347/104
2005/0285886 A1 12/2005 Okamoto ..... 347/7
2007/0091154 A1 4/2007 Katayama et al. ..... 347/86
2008/0231650 A1 9/2008 Kojima et al. ..... 347/17

FOREIGN PATENT DOCUMENTS

EP 0287098 10/1988
EP 0904940 3/1999
EP 2072266 6/2009
JP 2005034999 2/2005

* cited by examiner

*Primary Examiner* — Anh T. N. Vo
(74) *Attorney, Agent, or Firm* — Adams & Wilks

(57) ABSTRACT

An ink jet recording apparatus has a sub tank that supplies ink from an ink cartridge to an ink jet head carried by a reciprocating carriage. The sub tank has an ink container formed of two opposed resin films welded together around their peripheries, and resin sheet members are attached to the ink container over the weld portion for expanding the ink container and restoring it to its original shape after the ink container is deformed by ink flowing in or out of the ink container. The sheet members may be polyimide tape strips or the like that have higher resilience than the material of the ink container and prevent plastic deformation of the ink container due to expansion and compression thereof as ink flows in and out of the ink container.

5 Claims, 6 Drawing Sheets

INK JET RECORDING APPARATUS

BACKGROUND OF THE INVENTION

The present invention relates to a recording apparatus, and more particularly, to an ink jet recording apparatus.

Conventionally, as described in Japanese Patent Application Laid-open No. 2005-34999, there is disclosed a system which maintains a constant pressure by providing a pressure reducing pump and an atmosphere communication valve to a sub tank, sensing a pressure in the sub tank with a pressure sensor, and driving the pressure reducing pump or driving the atmosphere communication valve based on the pressure value. In addition, an ink jet printer has ink jet heads for individual ink colors, so that sub tanks are provided for individual colors.

However, in the conventional technique, it is necessary to provide pressure reducing pumps that are driven independently to the individual sub tanks. Therefore, the number of components increase, and the system is upsized. In addition, the ink jet head, the sub tank, the pressure reducing pump, the pressure sensor, and the like are mounted on a carriage, resulting in an increase of weight of the carriage. Therefore, a drive motor for driving the carriage is required to be upsized. The increase of the number of components and the upsizing of the drive motor cause an increase of cost. Further, because of contact between ink and air, dissolving of air containing oxygen and nitrogen in the ink occurs, which causes a rapid decrease of pressure accompanying air bubbles when an abrupt flow of ink occurs during a printing operation or a cleaning operation. The air bubbles generate pressure relaxation effect of the ink jet heads and cause ink discharge failure. In addition, if the ink temperature is raised by an increase of temperature of the ink jet heads, acceptable gas dissolving amount in the ink is decreased. Therefore, air bubbles are apt to be generated.

On the other hand, a sub tank having sealed structure has been devised, in which a tension force of a spring or a weight is utilized so that a negative pressure is generated inside. Further description is given with reference to FIG. 5. FIG. 5 is a schematic diagram of an ink container of a conventional sub tank. Two sheets are welded at the periphery thereof so as to have an inlet 9 and an outlet 10 for ink. In order to generate a negative pressure in the ink container 2, a biasing portion 37 uses a tension force of a spring, a weight, or the like for biasing. The internal pressure can be changed by expanding or compressing the ink container 2. In this conventional sub tank, a material and a hardness of the ink container 2 of the sub tank forming the sealed structure largely affect the generated internal pressure. In other words, in order to enhance a gas barrier property, it is necessary to form the ink container 2 of the sub tank by using sheets of structure having both ink resistance and gas barrier property. Therefore, multilayered structure made of plastic thin films or aluminum foil is adopted, and elastic sheets are used. However, as the sheets become harder, a change of pressure increases due to a volume change of the sheets. Thus, it becomes difficult to generate an appropriate back pressure with respect to the ink jet heads. Naturally, the sheet materials for the ink container 2 of the sub tank are restricted, and the softest material among them is selected. However, as the material becomes softer, the ink container 2 is apt to change its volume and has little change of pressure while having poor ability to maintain the shape. If the ink container 2 has once irregular creases 38 and 39, it cannot be restored so that stability of the pressure and repeatability of deformation cannot be maintained. In addition, there is another problem that a fluctuation of pressure among individual ink containers 2 of the sub tank is large.

The reason for those problems is that as the ink container 2 of the sub tank is being filled with ink and is being expanded, the irregular creases 38 and 39 are generated partially at the periphery of the ink container of the sub tank so as to generate a distortion at the periphery, and the distortion causes a plastic deformation. Thus, stability of the operation repeating compression and expansion of the ink container 2 of the sub tank is inhibited when the ink flows in or out of the ink container 2 of the sub tank. Further, there is a fluctuation of deformation of the ink container 2 of the sub tank, which causes a pressure fluctuation among individual ink containers 2 of the sub tank.

SUMMARY OF THE INVENTION

In order to solve the above-mentioned problem, the present invention disposes expansion means at a position of an ink container of a sub tank, which is apt to cause a plastic deformation, to thereby prevent the plastic deformation. A reinforcing material that has higher resilience than the material of the ink container of the sub tank is fixed. Alternatively, an external force is applied to the part that is apt to cause the plastic deformation by the expansion means in the deformation direction, to thereby prevent the plastic deformation of the ink container of the sub tank. As the reinforcing material, it is possible to use a resin sheet, a resin or metal plate, or the like. The reinforcing material may be fixed to the ink container by an adhesive or by welding. By fixing the reinforcing material to the ink container of the sub tank, it is possible to control the deformation due to expansion or compression of the ink container when ink flows in or out. Alternatively, a spring may be used as the external force.

According to the present invention, a change of internal pressure due to a plastic deformation of the ink container of the sub tank is prevented so that the internal pressure of the sub tank can be maintained to be constant. Thus, a fluctuation of pressure among individual ink containers is suppressed. Ink discharge from the ink jet head is stabilized and a discharge failure can be prevented, so that deterioration of print image quality can be prevented.

DETAILED DESCRIPTION OF THE PREFERRED EMBODIMENTS

Embodiments of the present invention are described with reference to the attached drawings.

Figure 2:
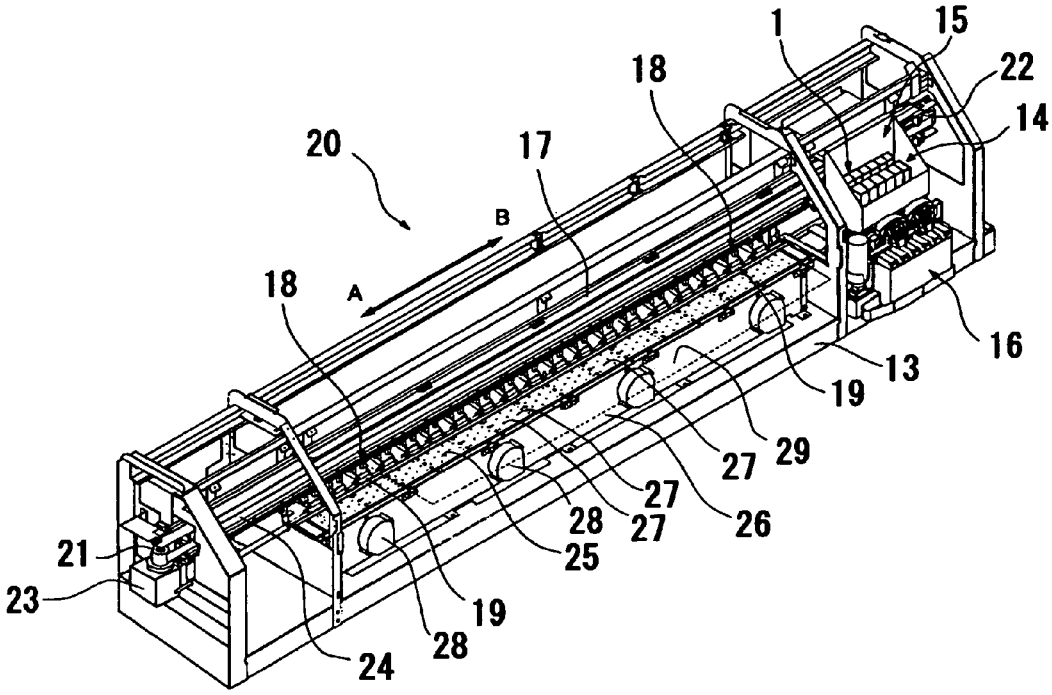
FIG. 2 is a perspective view illustrating structure of a recording apparatus according to an embodiment of the present invention.

First, a recording apparatus in its entirety is described with reference to FIG. 2. FIG. 2 is a perspective view illustrating structure of the recording apparatus according to an embodiment of the present invention. An ink jet recording apparatus 20 conveys a sheet-like or plate-like recording medium 29 as illustrated in FIG. 2 by a broken line and records images and characters corresponding to image data on a surface of the recording medium 29 by an ink jet method. The recording medium 29 is a sheet or the like made of paper, fabric, or a synthetic resin such as polyester or PVC.

The ink jet recording apparatus 20 includes a conveyor roller 19 that is driven by a motor to rotate, and a pressure roller unit 18 which presses the conveyor roller 19. The recording medium 29 is sandwiched between the conveyor roller 19 and the pressure roller unit 18 and is conveyed by rotation of the rollers.

A platen 25 which supports the recording medium 29 is disposed on the downstream side of the conveyor roller 19 and the pressure roller unit 18 in a conveying direction. This platen 25 is disposed at a position where an ink jet head 14 prints and records images and characters on the recording medium 29. In addition, beneath the platen 25, a heater is provided for heating the platen 25. This heater heats the platen 25 and also the recording medium 29, so as to facilitate fixation of ink discharged onto the recording medium 29.

The platen 25 is disposed so as to extend in a direction perpendicular to the conveying direction of the recording medium 29. In addition, the conveyor roller 19 and the pressure roller unit 18 make a pair, and 19 pairs of them are arranged at a predetermined interval, e.g., at an interval of 87.65 mm on the same axis line of the position adjacent to the platen 25.

The ink jet recording apparatus 20 is equipped with suction means for sucking the recording medium 29 to the platen 25. The suction means includes a plurality of suction holes 27 penetrating through the platen 25, a plurality of suction fans 28 which suck air, and a suction chamber 26 which communicates the suction holes 27 with the suction fan 28. The interior of the suction chamber 26 is divided into four cells, and each of the cells is equipped with the suction fan 28.

The ink jet recording apparatus 20 is equipped with a carriage 15 housing the ink jet head 14, which discharges ink droplets to the recording medium 29 for recording, and a sub tank 1 that supplies the ink to the ink jet head 14, a conveyor belt 24 which is coupled to the carriage 15, a drive pulley 21 and a driven pulley 22 for moving the conveyor belt 24, a drive motor 23 which drives the drive pulley 21 to rotate, and a guide rail 17 which guides scanning of the carriage 15 in the direction perpendicular to the conveying direction of the recording medium 29. The carriage 15 is adapted to move in a sliding manner in a direction crossing the conveying direction of the recording medium 29, e.g., the direction perpendicular to the same, that is, in a direction as illustrated in the diagram by the bidirectional arrow AB.

In addition, the ink to be supplied to the ink jet head 14 is stored in an ink cartridge 16. The ink cartridge 16 is a cartridge ink container that is exchangeable. The ink cartridge 16 is exchanged when ink runs out.

The sub tank 1 is disposed in an ink flow path for supplying the ink from the ink cartridge 16 to the ink jet head 14. The ink cartridge 16 supplies the ink to the sub tank 1, and the sub tank 1 supplies the ink to the ink jet head 14. The sub tank 1 is described later.

The ink jet head 14, the sub tank 1, the ink cartridge 16, and the ink flow path are provided for each color of ink. Structural elements including the conveyor roller 19, the pressure roller unit 18, the drive pulley 21, the driven pulley 22, the drive motor 23, the guide rail 17, and the like are attached to a pedestal 13.

Figure 1:
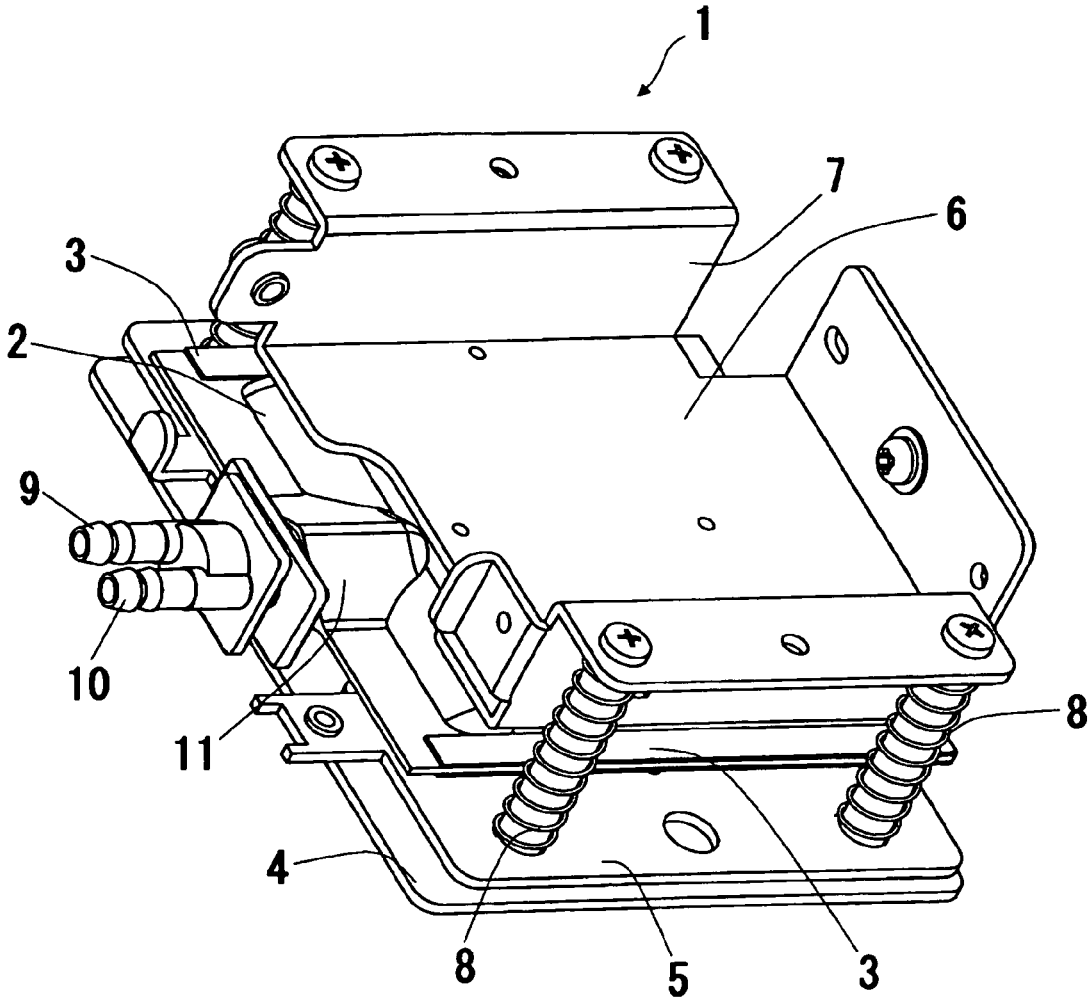
FIG. 1 is a perspective view of a sub tank of a recording apparatus according to the present invention.

Next, the sub tank 1 is described. FIG. 1 is a perspective view of the sub tank of the recording apparatus according to the present invention. The sub tank 1 generally includes an ink container 2 which stores the ink temporarily, and pressure adjustment means which changes an internal pressure of the ink container 2.

The ink container 2 has an inlet 9 that is connected to the ink cartridge 16 and is supplied with the ink, and an outlet 10 that is connected to the ink jet head 14 and delivers the ink.

The ink container 2 is formed by welding two rectangular film-like sheets to each other at the periphery thereof. Three peripheral sides of the ink container 2 are welded, and the remaining side is provided with the inlet 9 and the outlet 10 that are welded at a weld portion 11 for sealing. The ink container 2 is constituted by using at least one type of films made of resins such as polyethylene, polypropylene, polyethylene terephthalate, nylon, polyvinyl chloride, polyvinylidene chloride, polyvinyl alcohol, and an ethylene-vinyl alcohol copolymer for securing strength, ink resistance, and gas barrier property. The ink container 2 may be constituted by using a plurality of laminated films. Further, if it is necessary to secure higher gas barrier property, metal foil or a metallized film made of aluminum or other metal as an intermediate layer. The periphery of the ink container 2 is provided with expansion means 3. The expansion means 3 is described later.

A first pressure adjustment plate 5 is fixed to one of the flat surfaces of the ink container 2, and a second pressure adjustment plate 6 is fixed to the other opposed flat surface. Four shafts are fixed to a base plate 4, and the second pressure adjustment plate 6 is fixed to the ends of the shafts with screws. An attachment portion thereof is substantially the end portion of a bent portion 7 that is formed by bending each end portion of the second pressure adjustment plate 6 by 90 degrees and further bending the end portion thereof by 90 degrees. Expansion of the ink container 2 is defined by the length of the shafts. In addition, the first pressure adjustment plate 5 and the second pressure adjustment plate 6 can be fixed to the ink container 2 with an adhesive, double coated tape, or the like.

The first pressure adjustment plate 5 is biased in a direction separating it from the second pressure adjustment plate 6 by a force of springs 8 disposed respectively around the four shafts. In other words, the first pressure adjustment plate 5 and the second pressure adjustment plate 6 are biased in the direction separating them from each other, so that the ink container 2 is forced to expand. The force causes a decrease of the internal pressure so as to balance at a constant position. The sub tank 1 has such pressure adjustment means. Here, a head value of a nozzle is denoted by P, and a head value of the sub tank 1 is denoted by h. Then, it is desired that P-h be within the range from −3 to zero (kPa), so as to prevent leakage of the ink from the nozzle of the ink jet head 14 and a malfunction in the discharge. In addition, the base plate 4 is fixed to the carriage 15. The first pressure adjustment plate 5 and the second pressure adjustment plate 6 cannot be fixed directly to the carriage 15. Therefore, the attachment does not affect the ink container 2.

Further, if the sub tank 1 and the ink cartridge 16 are communicated with each other, the sub tank 1 may be affected by the head value of the ink cartridge 16 or, if a supply pump is used, the pressure of the supply pump. Therefore, a valve (not shown) is provided in the path, which disconnects between the inlet 9 of the sub tank 1 and the ink cartridge 16 or the supply pump at least during printing operation.

In addition, the ink jet head 14 for printing is disposed downstream of the outlet 10, so that a meniscus at the nozzle tip of the ink jet head 14 and the internal pressure of the sub tank 1 are balanced. Because the ink is supplied from the ink cartridge 16 to the sub tank 1, in order to prevent the ink jet head 14 from being affected by the head value of the ink cartridge 16 or the pressure of the supply pump during a supplying period, a valve (not shown) for disconnecting the flow path is disposed in the path between the outlet 10 and the ink jet head 14. During printing operation or when ink is supplied to the sub tank 1, the valve (not shown) is controlled.

Figure 3:
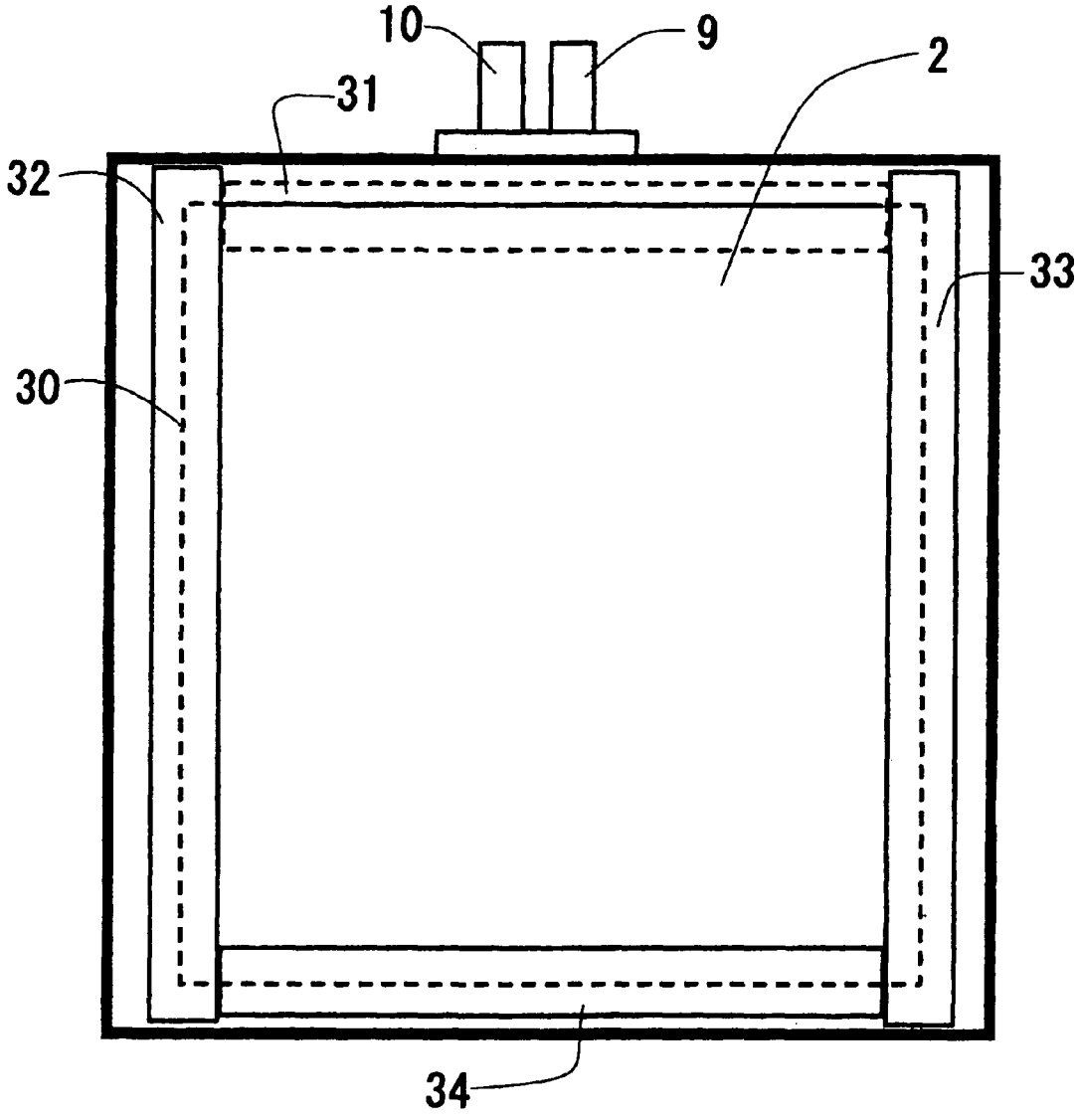
FIG. 3 is a schematic diagram illustrating a first form of an ink container of the sub tank that is used for the recording apparatus of the present invention.

Next, the expansion means of the ink container 2 is described. FIG. 3 is a schematic diagram illustrating a first form of the ink container of the sub tank that is used for the recording apparatus of the present invention.

The ink container 2 is constituted of two resin films that are welded and sealed at the periphery of the ink container 2 outside a weld portion boundary 30. The weld portion boundary 30 is indicated by a solid line on the side to which the inlet 9 and the outlet 10 are provided, and by broken lines on the other three sides. Polyimide tape strips 32, 33, and 34 having a width of 8 mm as a reinforcing material, i.e., the expansion means are applied to the three sides of the ink container 2 across the weld portion boundary 30 for reinforcing the periphery portion. In addition, a polyimide tape strip 31 having a width of 8 mm as the reinforcing material, i.e., the expansion means is applied to one surface of the side to which the inlet 9 and the outlet 10 are provided. In this way, resilience that restores an original shape of the ink container 2 after being deformed by the ink flowing in or out of the ink container is increased by applying the polyimide tape strip 31. In other words, the original shape of the ink container 2 can be restored easily, so that a plastic deformation can be prevented. The plastic deformation is apt to occur in the periphery of the weld portion or the edge portion of the container. Therefore, the expansion means can prevent the plastic deformation.

The place where the plastic deformation is apt to occur is different depending on a size, a material, and a method of fixing of the ink container 2. Accordingly, the position and method of attaching the expansion means may be different. In the case of FIG. 1, the sheet-like expansion means is attached up to the end portion of the periphery. In the example of FIG. 3, the polyimide tape strips 31 to 34 are applied so as to cover the weld portion boundary 30. Further, the polyimide tape strip 31 is applied to only one surface of the ink container 2, and the polyimide tape strips 31 to 34 are applied to both surfaces. It is because that the side to which the inlet 9 and the outlet 10 for the ink are connected has a smaller plastic deformation than the other sides.

The polyimide tape strips may be applied across the weld portion boundary 30 corresponding to the polyimide tape strip 31. Thus, the reinforcing material is provided on both sides of the weld portion boundary 30 of all four sides, so that the effect can be further increased.

As another form, the reinforcing material is not limited to polyimide, and a sheet-like material made of a resin such as rubber, nylon, or the like, which has higher resilience than the material of the ink container 2, may be used. In addition, as another reinforcing material, a thin plate made of a resin or a metal may be used. The reinforcing material may be fixed to the ink container with an adhesive or by welding.

Figure 4:
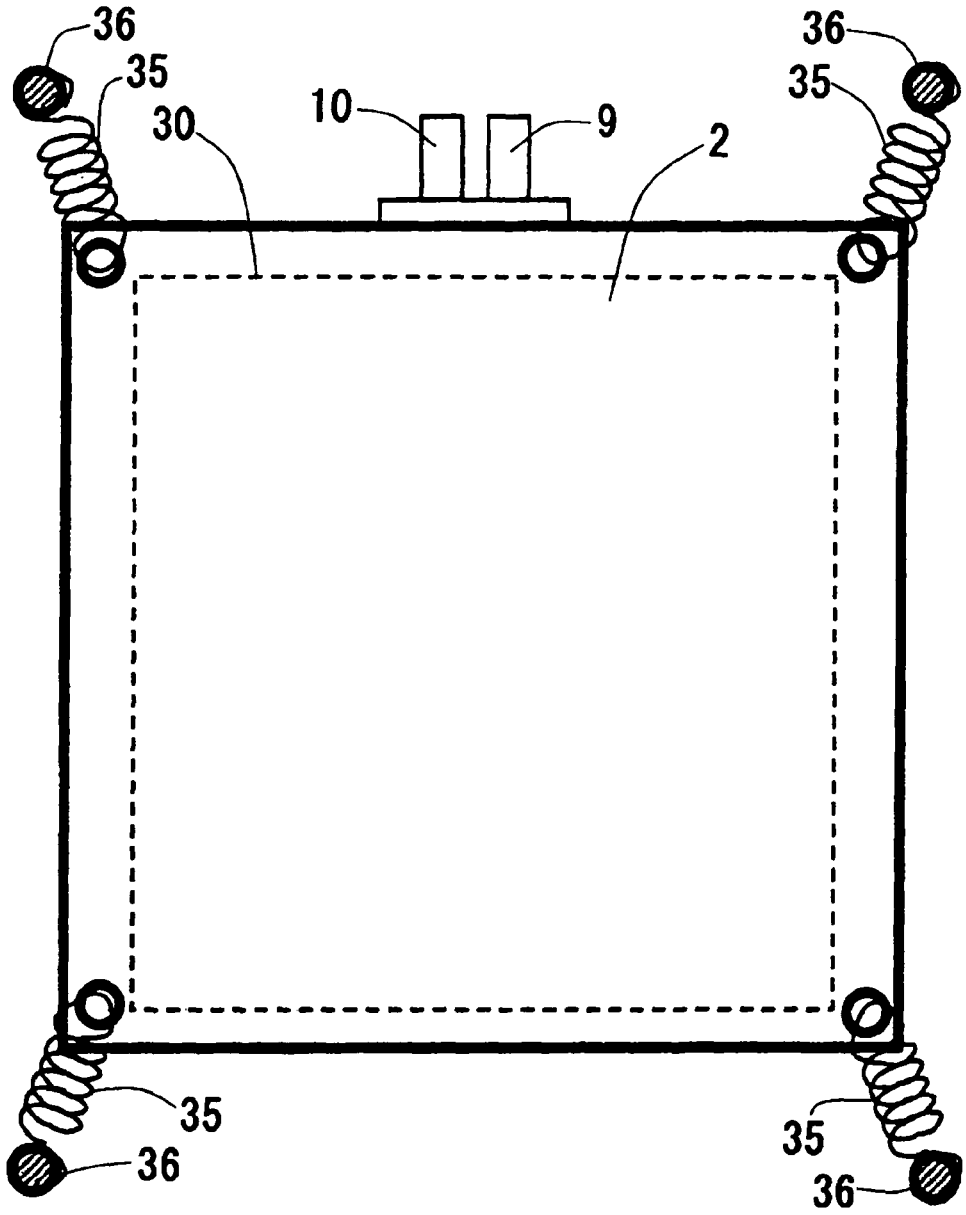
FIG. 4 is a schematic diagram illustrating a second form of the ink container of the sub tank that is used for the recording apparatus of the present invention.
Figure 5:
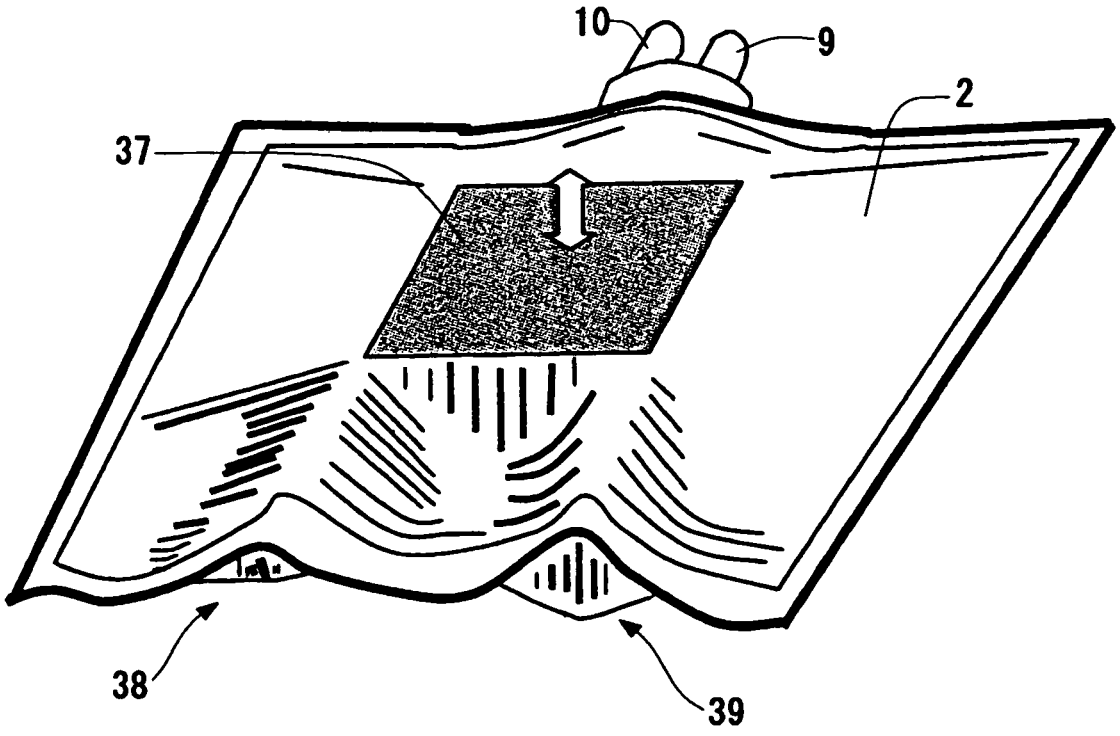
FIG. 5 is a schematic diagram of an ink container of a conventional sub tank.

FIG. 4 is a schematic diagram illustrating a second form of the ink container of the sub tank that is used for the recording apparatus of the present invention. An end of a spring 35 is attached to each of four corners of the ink container 2, and the base plate 4 is provided with fixing means 36, to which the other ends of the springs 35 are respectively fixed, so that the ink container 2 is pulled to extend in four directions. In this case, because forces are always applied to the ink container 2 so as to extend in the four directions, the ink container 2 causes little distortion or bending so that a plastic deformation can be prevented.

Figure 6:
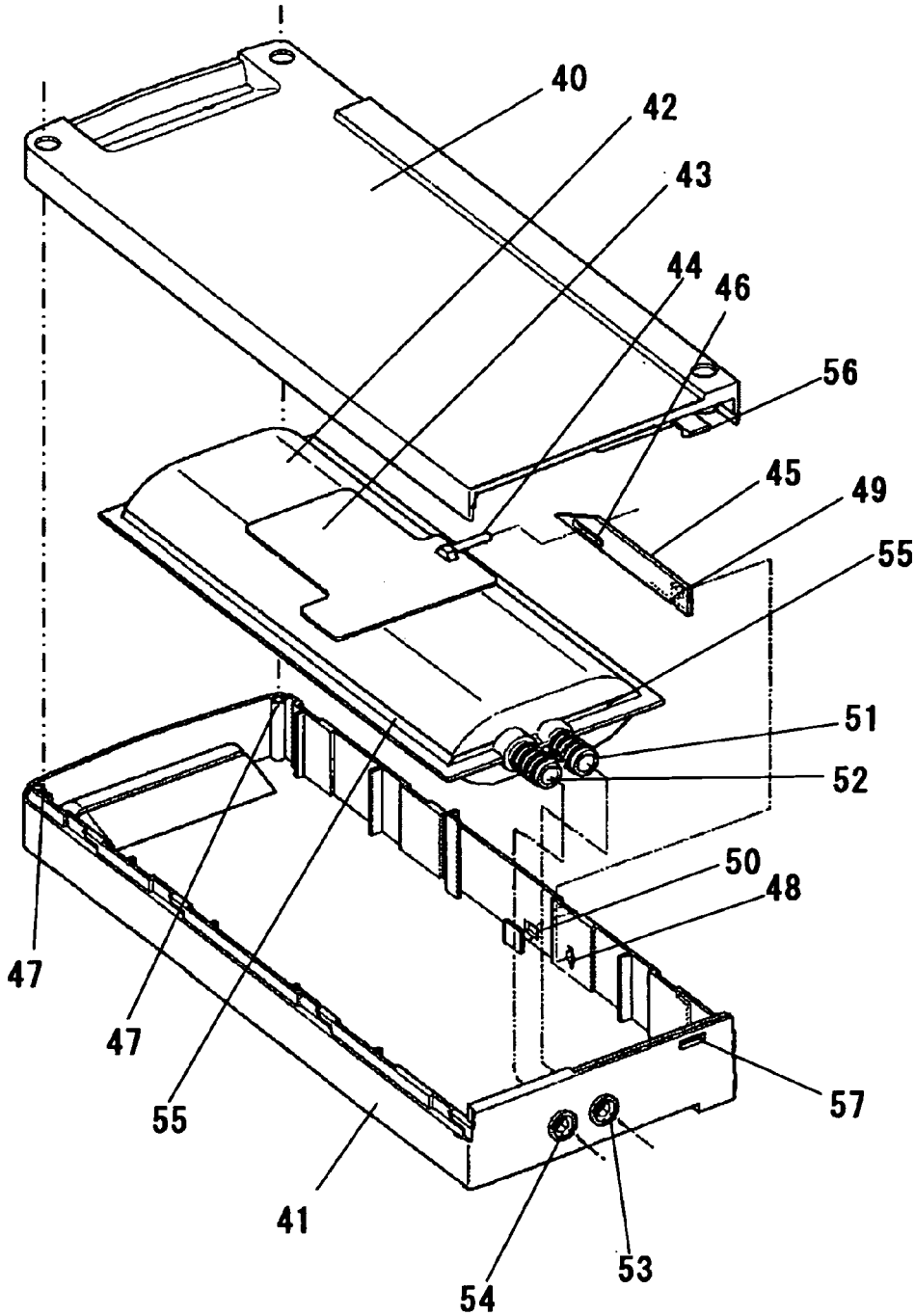
FIG. 6 is a diagram illustrating structure of a sub tank according to another embodiment of the present invention.

FIG. 6 is a diagram illustrating structure of the sub tank according to another embodiment of the present invention. The sub tank includes an outer case. An upper case 40 and a lower case 41 house the ink container 42. A protrusion 56 of the upper case 40 is inserted into an engaging portion 57 of the lower case 41, so that the upper case 40 and the lower case 41 are coupled to each other. Further the upper case 40 and the lower case 41 are fixed to each other with screws put into thread grooves 47 of the lower case 41.

The ink container 42 is a flexible container for housing ink. A plate 43 is fixed to one side face of the ink container 42. The ink container 42 is expanded or compressed in accordance with a volume of the ink in the ink container 42, so that the plate 43 moves in accordance with the expansion or compression of the ink container 42. A protruding portion 44 is provided to an end portion of the plate 43. The ink container 42 is provided with an inlet 51 for filling the ink in and an outlet 52 for delivering the ink. Correspondingly, the lowercase 41 is provided with an inlet opening 53 for the inlet 51 and an outlet opening 54 for the outlet 52. The inlet 51 and the outlet 52 are connected to the ink path in the recording apparatus. When the ink is filled through the inlet 51, the ink container 42 is expanded. When the ink is delivered through the outlet 52, the ink container 42 is compressed.

Further, the lower case 41 is provided with a shaft fixing hole 48. A detection plate 45 is provided with a rotation shaft 49 at one end and a long hole 46 at the other end. The rotation shaft 49 is inserted into the shaft fixing hole 48 so that the detection plate 45 can rotate about the rotation shaft 49. The protruding portion 44 of the plate 43 is inserted into the long hole 46. In this way, as the plate 43 moves, the detection plate 45 rotates about the rotation shaft 49. The lower case 41 is provided with a window 50. If the ink container 42 is filled enough with the ink, the detection plate 45 does not block the window 50. If the ink container 42 runs out of the ink, the detection plate 45 blocks the window 50. In this way, because the detection plate 45 works in accordance with the volume of the ink in the ink container 42, it is possible to detect the volume of the ink in the ink container 42 from whether the window 50 is blocked or not. Using an optical sensor including a light emission portion and a light receiving portion for detecting a state of the window 50, the volume of the ink in the ink container 42 can be detected.

The ink container 42 is used as the sub tank of the recording apparatus, and the ink is filled in or delivered from the ink container 42. Therefore, the ink container 42 is expanded and compressed frequently. In addition, if the ink container 42 has an abnormal deformation such as a plastic deformation, the volume of the ink cannot be detected correctly. Therefore, a reinforcing material 55 is provided on both sides of the weld portion boundary at the periphery of the ink container 42. The plastic deformation of the ink container 42 can be prevented. In addition, it is preferred that the reinforcing material 55 be disposed not to prevent the movement of the plate 43. For instance, at the overlapping portion of the plate 43 or the protruding portion 44 with the reinforcing material 55, the reinforcing material 55 having a thickness that does not prevent the movement is applied. In addition, the arrangement is performed so that the plate 43 or the protruding portion 44 does not contact with the reinforcing material 55. In this way, the reinforcing material 55 does not prevent the movement of the detection plate 45.

INDUSTRIAL APPLICABILITY

The present invention can be used for a recording apparatus such as an ink jet printer having a sub tank.

What is claimed is:

1. An ink jet recording apparatus, comprising:

an ink jet head which discharges ink to a recording medium;

a carriage which carries the ink jet head and moves in a reciprocating manner in a direction crossing a conveying direction of the recording medium;

an ink cartridge which stores the ink to be supplied to the ink jet head;

an ink supply path which communicates the ink jet head with the ink cartridge; and a sub tank mounted on the carriage and connected to the ink supply path, the sub tank including an ink container having an inlet connected to the ink cartridge and an outlet connected to the ink jet head, expansion means having higher resilience than the ink container and being disposed at a peripheral portion of the ink container for expanding the ink container and restoring it to its original shape after the ink container is deformed, and pressure adjustment means for maintaining an internal pressure of the ink container constant, the pressure adjustment means including plates fixed to flat surface portions of the ink container and springs for biasing the plates in directions separating the plates from each other so that the internal pressure of the ink container is maintained lower than an external pressure.

2. An ink jet recording apparatus according to claim 1; wherein the expansion means comprises a sheet member made of a resin and fixed to the ink container.

3. An ink jet recording apparatus according to claim 2; wherein the ink container is constituted of two resin films that are welded to each other at their periphery, and the expansion means is arranged at a boundary of the weld portion.

4. An ink jet recording apparatus according to claim 1; wherein each of the plates has a recess for avoiding portions of the outlet and the inlet in the periphery forming the ink container, so that the outlet and the inlet do not contact with the plates when the ink container is compressed.

5. An ink jet recording apparatus, comprising:

an ink jet head which discharges ink to a recording medium;

a carriage which carries the ink jet head and moves in a reciprocating manner in a direction crossing a conveying direction of the recording medium;

an ink cartridge which stores the ink to be supplied to the ink jet head;

an ink supply path which communicates the ink jet head with the ink cartridge; and a sub tank mounted on the carriage and connected to the ink supply path, the sub tank including an ink container having an inlet connected to the ink cartridge and an outlet connected to the ink jet head, and expansion means having higher resilience than the ink container and being disposed at a peripheral portion of the ink container for expanding the ink container and restoring it to its original shape after the ink container is deformed, wherein the expansion means pulls end portions of the ink container with springs in an expanding direction so as to expand the ink container.

* * * * *